United States Patent [19]

Wong

[11] Patent Number: 4,946,172

[45] Date of Patent: Aug. 7, 1990

[54] SAFETY DART

[75] Inventor: Tak-Ko Wong, Wanchai, Hong Kong

[73] Assignee: Franklin Sports Industries, Inc., Stoughton, Mass.

[21] Appl. No.: 311,595

[22] Filed: Feb. 16, 1989

[51] Int. Cl.[5] ..... A63B 65/02

[52] U.S. Cl. ..... 273/420

[58] Field of Search ..... 273/416, 420, 423, 417, 273/419

[56] References Cited

U.S. PATENT DOCUMENTS

| | | | |
|---|---|---|---|
| 1,424,674 | 8/1922 | Orr | 273/420 |
| 2,443,395 | 6/1948 | Lutins | 273/420 X |
| 2,976,042 | 3/1961 | Barnett | 273/423 |
| 3,596,910 | 8/1971 | Rizzo | 273/420 |
| 3,749,402 | 7/1973 | Adickes et al. | 273/417 X |
| 3,784,199 | 1/1974 | Chmela | 273/420 X |
| 3,894,736 | 7/1975 | Foley | 273/95 R |
| 3,949,729 | 4/1976 | Pfotenhauer | 124/20 R |
| 3,963,017 | 6/1976 | Pfotenhauer | 124/21 |
| 3,968,783 | 7/1976 | Pfotenhauer | 124/25 |
| 3,997,162 | 12/1976 | Scullin | 273/95 R |
| 4,103,893 | 8/1978 | Walker | 273/106.5 |
| 4,121,586 | 10/1978 | Lawrence et al. | 128/215 |
| 4,283,061 | 8/1981 | Jordan | 273/423 |
| 4,328,971 | 5/1982 | Stone et al. | 273/408 |
| 4,350,898 | 9/1982 | Benoit | 290/55 |
| 4,537,176 | 8/1985 | Stravitz et al. | 124/62 |
| 4,541,402 | 9/1985 | Winters | 124/27 |
| 4,597,580 | 7/1986 | Gassie | 273/418 |

FOREIGN PATENT DOCUMENTS

| | | | |
|---|---|---|---|
| 620536 | 3/1949 | United Kingdom | 273/423 |

*Primary Examiner*—Paul E. Shapiro

*Attorney, Agent, or Firm*—Weingarten, Schurgin, Gagnebin & Hayes

[57] ABSTRACT

A safety lawn dart having a blunt deformable nose section. The blunt nose section is a safety feature permitting use of the lawn dart without fear of the injury associated with the use of existing lawn darts having pointed tips. A shock-absorbing telescopic intermediate section may be added to increase the deadening effect upon impact of the dart with the ground or target. A tail section is fixably or slideably and rotatably mounted on the dart shaft to promote aerodynamic stability.

16 Claims, 3 Drawing Sheets

SAFETY DART

FIELD OF THE INVENTION

The present invention relates to the game of lawn darts and in particular to a safety lawn dart having a deformable nose section to prevent injury to the players and to bystanders.

BACKGROUND OF THE INVENTION

Lawn darts have provided outdoor entertainment to adults and children for many years. Existing lawn darts typically comprise a pointed tip, a shaft and a tail section. The tip of the traditional lawn dart is sufficiently pointed to penetrate the ground upon landing. Associated with the traditional lawn dart, however, is the ever-present threat of accidental injury to the players and to bystanders. In recent years, severe injuries have been reported resulting from the use of traditional lawn darts. The majority of these injuries have been puncture wounds to children caused by the tip of the flying lawn dart. Sufficient concern has been expressed regarding the safety of the traditional lawn dart, that legislation has been passed restricting the use of such darts.

The present invention is designed not to penetrate the ground and includes a nose section which will not penetrate human skin under normal use. The present invention is also advantageous in that it may be used indoors.

SUMMARY OF THE INVENTION

The safety lawn dart of the present invention is designed to be used in the same manner as the traditional lawn dart. The safety lawn dart is grasped by the tail section or, in another embodiment, by the distal end of the dart shaft, and is thrown towards the target. The center of gravity of the safety lawn dart is located nearer the nose section than the distal end of the dart shaft, ensuring that the nose section makes first contact with the target upon landing.

The nose section is generally bulbous in shape and deformable to avoid penetration of the target and of skin and to deaden and minimize the bounce of the dart upon impact with the target. In one embodiment, the intermediate section of the safety lawn dart is telescopic and retracts upon landing to further reduce the propensity of the dart to bounce upon landing.

The tail section of the safety dart provides aerodynamic stability during flight. The tail section may be fixably or slideably and rotatably mounted on the dart shaft. In the slideable and rotatable embodiment, the tail section is disposed forwardly and exposes the distal end of the dart shaft to be grasped by the player when throwing of the dart. During flight, the tail section shifts toward the distal end of the dart shaft to provide enhanced aerodynamic stability.

In another embodiment of the present invention, a further aerodynamic surface is peripherally mounted on the intermediate section to increase aerodynamic stability during flight. In addition, after the dart has landed, this aerodynamic surface maintains the dart shaft in an elevated position to facilitate the players' identification of the location of the dart.

DESCRIPTION OF THE DRAWINGS

The present invention will be more fully understood from the following detailed description taken in conjunction with the accompanying drawings in which.

DETAILED DESCRIPTION OF THE INVENTION

Figure 1:
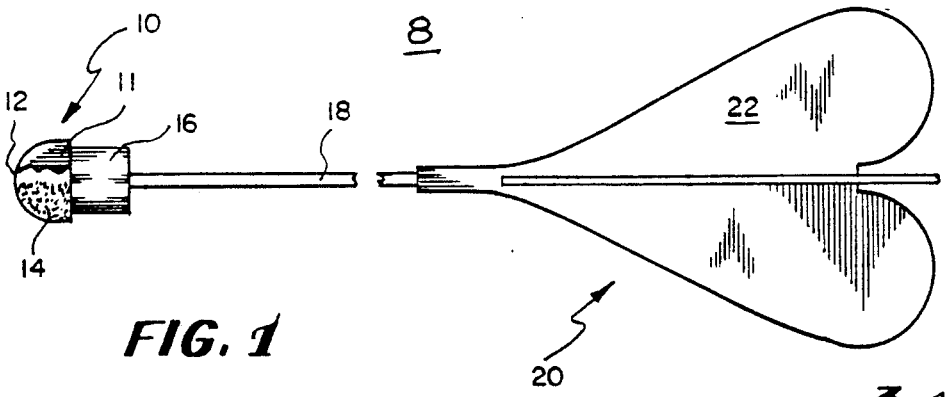
FIG. 1 illustrates a first embodiment of the present invention.

Referring now to FIG. 1, a first embodiment of the safety dart 8 of the present invention is illustrated. In this embodiment, nose section 10 is substantially semi-spherical in shape. Nose section 10 is manufactured of a deformable material, such as latex rubber, which deforms on impact with the target, typically the ground. Nose section 10 comprises a substantially hollow member 11. The thickness of nose section wall 12 is sufficient, when the material from which nose section 10 is manufactured is taken into consideration, to permit the nose section 10 to deform on impact with the target. In addition, nose section 10 partially or fully contains bounce retarding particulate matter 14 such as sand or plastic chips. This material increases the deadening effect of the deformable nose section 10 upon impact with the target.

Connected to nose section 10 is an intermediate section 16. Intermediate section 16 has a substantially cylindrical shape although other shapes may be used without materially affecting the aerodynamic parameters of the safety dart. Extending from intermediate section 16 is an elongated shaft 18. Mounted on shaft 18 is a tail section 20 which has at least one aerodynamic surface 22. Nose section 20 may be affixed to intermediate section 16 by gluing, bonding or by other means known to those of ordinary skill in the art. Intermediate section 16, shaft 18 and tail section 20 may be integrally formed or, alternatively, may be manufactured separately and connected together by bonding, tacking or by other means known to those of ordinary skill in the art.

Figure 2:
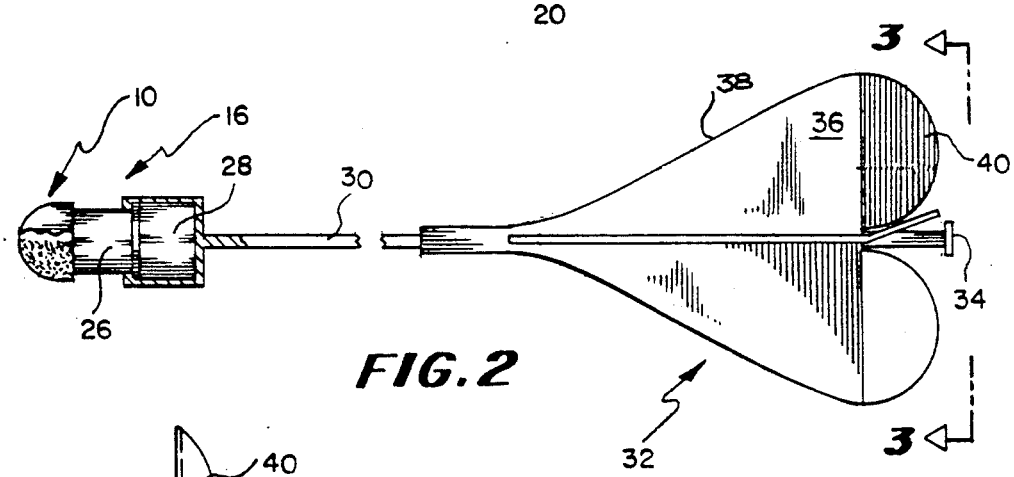
FIG. 2 illustrates a second embodiment of the present invention.

Referring now to FIG. 2, another embodiment of the safety dart of the present invention is illustrated. In this embodiment, intermediate section 16 comprises a first telescoping member 26 and second telescoping member 28. Second telescoping member 28 is connected to shaft 30 and is dimensioned to receive first telescoping member 26 in sliding telescopic engagement. First telescoping member 26 is connected to nose section 10. Upon impact with the target, nose section 10 deforms as described above and first telescoping member 26 retracts into second telescoping member 28, thus absorbing the shock of impact and reducing the propensity of the dart to bounce.

Figure 3:
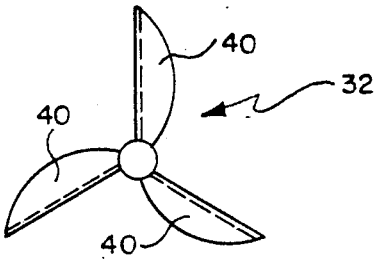
FIG. 3 illustrates an end view of the tail section of the Present invention.

Tail section 32 is slidingly and rotatably mounted on shaft 30. Retaining member 34 prevents tail section 32 from becoming detached from shaft 30. Tail section 32 comprises at least one first aerodynamic surface 36 having a swept-back leading edge 38. Referring now also to FIG. 3, tail section 32 may also include at least one second aerodynamic surface 40 associated with, and at an angle to, each first aerodynamic surface 38. Second aerodynamic surface 40 urges tail section 32 to rotate about shaft 30 during flight and increases the aerodynamic stability of the safety dart.

Of course, other tail section configurations are possible and will occur to those of ordinary skill in the art. For example, tail section 32 may include 2, or 4 or more first aerodynamic surfaces 36 each having a corresponding second aerodynamic surface 40, as shown in FIG. 3.

Figure 5:
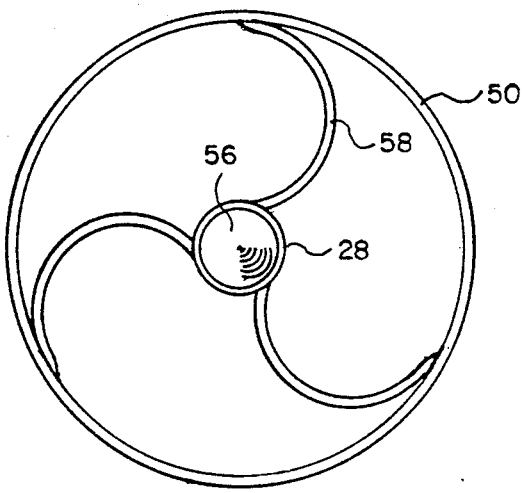
FIG. 5 is a front end view of the peripheral aerodynamic surface of the present invention.
Figure 4:
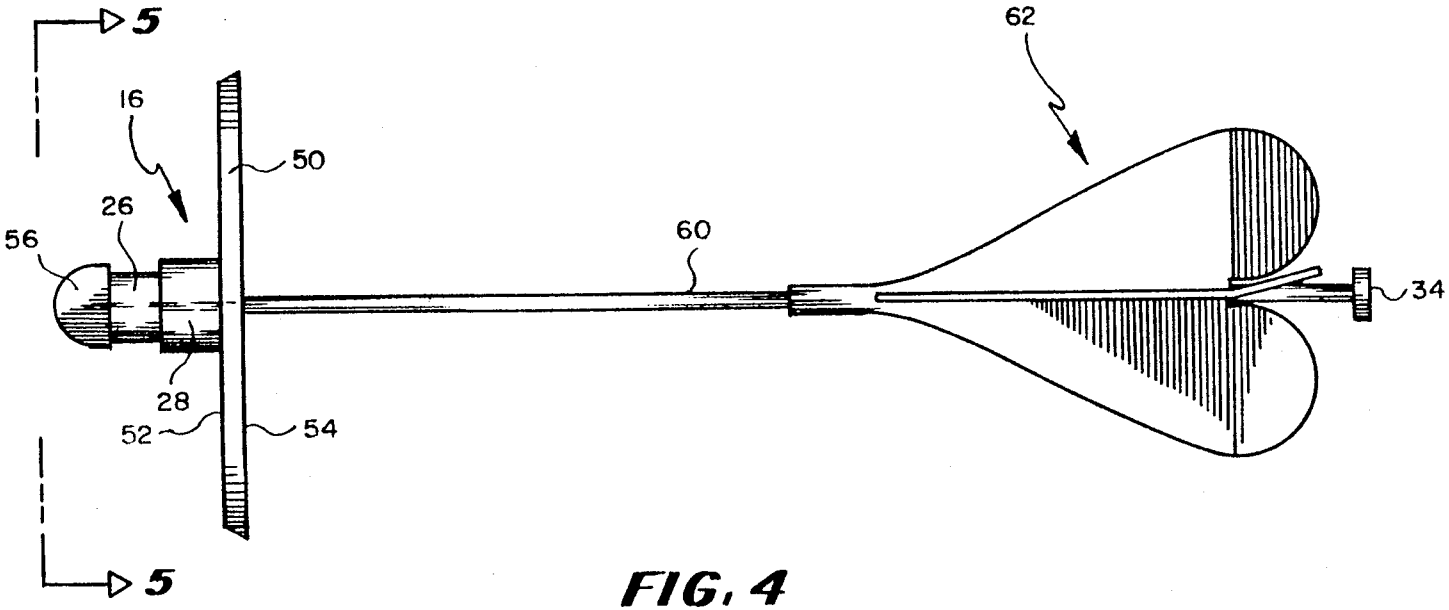
FIG. 4 illustrates a third embodiment of the present invention.

Referring now to FIGS. 4 and 5, another embodiment of the present invention is illustrated. In this embodiment, intermediate section 16 further comprises a peripherally mounted aerodynamic surface 50. Peripheral aerodynamic surface 50 comprises a leading edge 52 and a trailing edge 54. Leading edge 52 is disposed between trailing edge 54 and nose section 56 and has a diameter smaller than the diameter of trailing edge 54. Peripheral aerodynamic surface 50 is connected to second telescoping member 28 by at least one spoke 58. When they dart is in flight, peripheral aerodynamic surface 50 contributes to the aerodynamic stability of the dart. Peripheral aerodynamic surface 50 also functions to absorb impact upon landing. After the dart has landed, and as indicated in FIG. 6, peripheral dynamic surface 50 maintains shaft 60 and tail section 62 in an elevated position, thus rendering the dart easily visible to the players even at a remote distance.

Figure 6:
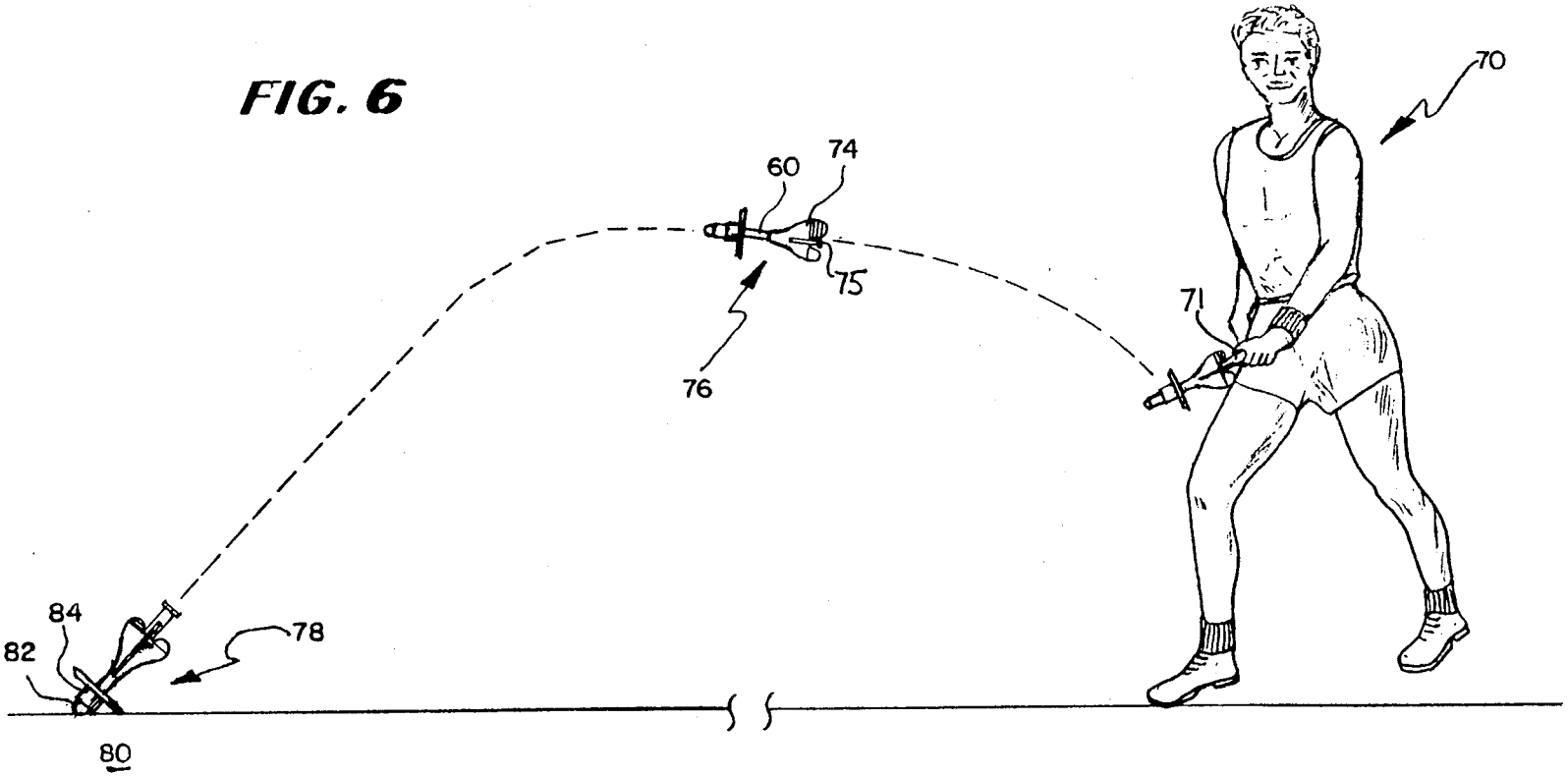
FIG. 6 illustrates the characteristics of the present invention during use.

FIG. 6 illustrates the features of the embodiment of the safety dart illustrated in FIG. 4 during use. Tail section 62 is initially slid along shaft 60 towards intermediate section 16. Player 70 thereafter grasps the exposed section 71 of shaft 60 proximate retaining member 34. At this time, the force of gravity causes first telescoping member 26 to become extended from second telescoping member 28. Once in flight, tail section 74 of dart 76 slides along shaft 60 until it abuts retaining member 75. During flight, first telescoping member 26 remains extended from second telescoping member 28.

Upon impact of dart 78 with the target 80, nose section 82 is deformed and first telescoping member is forced to retract into second telescoping member 84. The combined effect of the deformation of nose section 82 and the retraction of first telescoping member into second telescoping member 28 is to cause safety dart 78 to come to rest at a position in substantially the same place at which nose section 82 first makes contact with target 80. Similarity between the game of lawn darts using the present invention and using the pointed darts of the prior art is thereby enhanced. Risk of injury to the players and bystanders from the tip of the safety dart is also virtually eliminated.

Having above indicated preferred embodiments of the present invention, it will occur to those skilled in the art that modifications and alternatives can be practiced within the spirit of the invention. It is accordingly intended to define the scope of the invention only as indicated in the following claims.

I claim:

1. A safety dart, comprising:

a deformable nose section;

an elongated shaft a substantially cylindrical intermediate section connected to said nose section, comprising:

first and second telescoping members;

said first telescoping member connected to said nose section and having a first diameter;

said second telescoping member connected to said elongated shaft and having a second diameter dimensioned to receive said first telescoping member in sliding engagement;

said elongating shaft extending from said intermediate section, said shaft having a distal end;

a tail section mounted on said elongated shaft; and wherein the center of gravity of said dart is located nearer to said nose section than to said shaft distal end.

2. The safety dart of claim 1, wherein said nose section includes a shock absorbing member.

3. The safety dart of claim 2, wherein said shock absorbing member comprises a hollow deformable bulb.

4. The safety dart of claim 3, wherein said hollow deformable bulb is manufactured from an elastomeric material.

5. The safety dart of claim 3 wherein said hollow deformable bulb contains bounce-retarding material.

6. The safety dart of claim 1, wherein said tail section comprises at least one first aerodynamic surface having a swept-back leading edge.

7. The safety dart of claim 6, wherein each said at least one first aerodynamic surface includes an integrally formed second aerodynamic surface disposed at an angle to the plane thereof.

8. The safety dart of claim 1, further comprising a retaining member disposed at the distal end of said shaft and wherein said tail section is slideably and rotatably mounted on said shaft between said intermediate section and said retaining member.

9. The safety dart of claim 1, wherein said tail section is fixedly mounted on said shaft and said shaft includes distal gripping means extending from said tail section.

10. The safety dart of claim 1 further comprising a peripheral aerodynamic surface peripherally mounted on said second telescoping member, the plane of said peripheral aerodynamic surface being perpendicular to the longitudinal axis of said dart.

11. The safety dart of claim 1, wherein said intermediate section, said shaft and said tail section are manufactured substantially of plastic.

12. A safety dart, comprising:

a deformable nose section;

an intermediate section connected to said nose section;

an elongated shaft extending from said intermediate section, said shaft having a distal end;

a tail section mounted on said elongated shaft;

a peripheral aerodynamic surface peripherally mounted on said intermediate section, the plane of said peripheral aerodynamic surface being perpendicular to the longitudinal axis of said dart; and wherein the center of gravity of said dart is located nearer to said nose section than to said distal end.

13. The safety dart of claim 12, further comprising:

at least one spoke, each said spoke having a first end connected to said intermediate section and a second end connected to said peripheral aerodynamic surface, and wherein said peripheral aerodynamic surface includes a leading edge and a trailing edge, the circumference of the trailing edge being greater than the circumference of the leading edge and said leading edge being disposed between said trailing edge and said nose section.

14. The safety dart of claim 12, wherein said intermediate section, said elongated shaft, said tail section, and said peripheral aerodynamic surface are manufactured substantially of plastic.

15. A safety lawn dart, comprising:

a deformable nose section;

an intermediate section including:

a first telescoping member connected to said nose section; and a second telescoping member connected to said first telescoping member and dimensioned to receive said first telescoping member in sliding engagement;

an elongated shaft extending from said second telescoping member and having a distal end;

retaining means disposed at said shaft distal end;

a tail section slideably and rotatably mounted on said shaft between said second telescoping member and said distal end retaining means, said tail section including at least one aerodynamic surface having a chord substantially parallel to the longitudinal axis of said dart, and wherein the center of gravity of said dart is located on the nose section side of the longitudinal midpoint of said dart.

16. The safety dart of claim 15, wherein said intermediate section, said elongated shaft, said retaining means and said tail section are manufactured substantially of plastic.

* * * * *